US008905393B2

(12) United States Patent
Ando et al.

(10) Patent No.: US 8,905,393 B2
(45) Date of Patent: Dec. 9, 2014

(54) SHEET POST-PROCESSING APPARATUS THAT PERFORMS BUFFER PROCESSING, AND IMAGE FORMING APPARATUS

(71) Applicant: Canon Kabushiki Kaisha, Tokyo (JP)

(72) Inventors: Yutaka Ando, Toride (JP); Mitsuhiko Sato, Kashiwa (JP); Toshiyuki Miyake, Abiko (JP); Takashi Yokoya, Kashiwa (JP); Hiromasa Maenishi, Matsudo (JP); Akihiro Arai, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/750,001

(22) Filed: Jan. 25, 2013

(65) Prior Publication Data

US 2013/0193630 A1 Aug. 1, 2013

(30) Foreign Application Priority Data

Jan. 26, 2012 (JP) ..... 2012-014196
Jan. 11, 2013 (JP) ..... 2013-003485

(51) Int. Cl.

| | |
|---|---|
| ***B65H 39/00*** | (2006.01) |
| ***B65H 37/00*** | (2006.01) |
| ***G03G 15/00*** | (2006.01) |
| ***B65H 31/30*** | (2006.01) |
| ***B65H 29/12*** | (2006.01) |
| ***B65H 39/10*** | (2006.01) |
| ***B65H 31/34*** | (2006.01) |

(52) U.S. Cl.

CPC ..... *B65H 39/00* (2013.01); *B65H 2301/4213* (2013.01); *B65H 37/00* (2013.01); *G03G 15/6544* (2013.01); *B65H 2801/27* (2013.01); *B65H 2301/5152* (2013.01); *B65H 31/3027* (2013.01); *B65H 29/125* (2013.01); *B65H 2515/112* (2013.01); *B65H 2301/4452* (2013.01); *B65H 2404/166* (2013.01); *B65H 39/10* (2013.01); *B65H 2511/30* (2013.01); *B65H 31/34* (2013.01); *B65H 2301/5126* (2013.01)

USPC ..... 270/58.01; 270/58.07

(58) Field of Classification Search

USPC ..... 270/20.1, 32, 45, 58.01, 58.07
See application file for complete search history.

(56) References Cited

U.S. PATENT DOCUMENTS

| | | | | |
|---|---|---|---|---|
| 7,281,707 | B2 * | 10/2007 | Moriyama et al. | 270/58.04 |
| 7,354,036 | B2 * | 4/2008 | Hayashi et al. | 270/58.12 |
| 2010/0007070 | A1 * | 1/2010 | Iguchi et al. | 270/18 |

FOREIGN PATENT DOCUMENTS

| | | | |
|---|---|---|---|
| CN | 1669806 | A | 9/2005 |
| JP | 2008-105316 | A | 5/2008 |

OTHER PUBLICATIONS

Chinese Office Action in Chinese counterpart application No. CN201310033006.4, dated Jul. 21, 2014. English translation provided.

*Primary Examiner* — Leslie A Nicholson, III

(74) *Attorney, Agent, or Firm* — Rossi, Kimms & McDowell LLP

(57) ABSTRACT

A sheet post-processing apparatus for performing post-processing on a sheet having an image formed thereon. A stapling section or a scoring section performs processing on a sheet and a sheet bundle. The upper limit value of a sheet count of sheets processable at a time by the post-processing unit is equal to N (N is an integer). A buffer path performs buffer processing for retaining a conveyed sheet, placing the retained sheet and a sheet following the retained sheet one on the other, and conveying the superimposed sheets as a sheet bundle. A CPU controls the buffer path the stapling section or the scoring section such that when the processing is being performed on the sheet or the sheet bundle, the buffer processing is performed on a following sheet, and that the processing is performed on each sheet bundle having been subjected to the buffer processing.

19 Claims, 15 Drawing Sheets

*FIG. 10A*
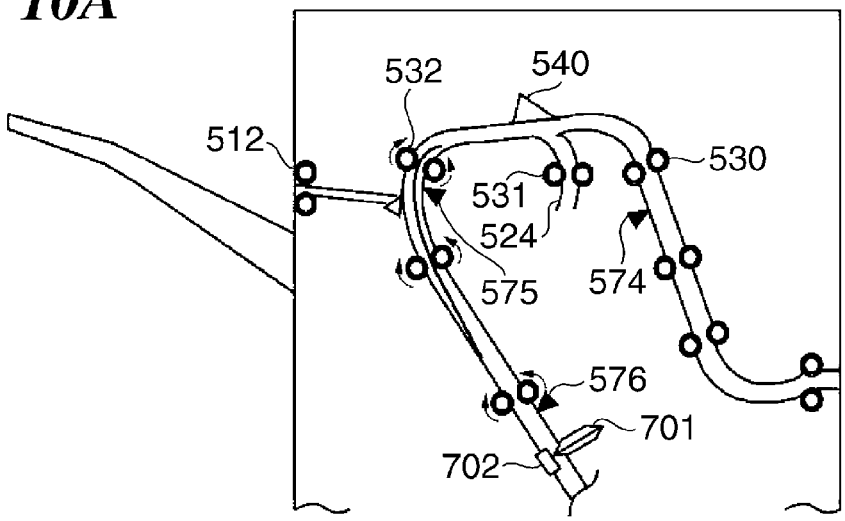
*FIG. 10B*
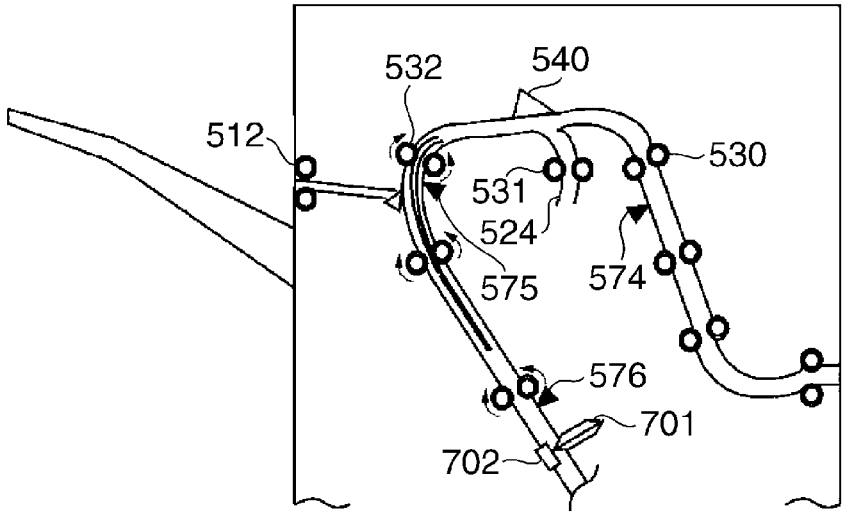
*FIG.11*
| | SHEET BASIS WEIGHT [g/mm$^2$] | | |
|---|---|---|---|
| | SMALLER THAN 64 | FROM 64 TO 129 | EQUAL TO OR LARGER THAN 129 |
| UPPER-LIMIT SHEET COUNT | 3 | 2 | 1 |

*FIG.14*

| | SHEET BASIS WEIGHT [g/mm$^2$] | |
|---|---|---|
| | SMALLER THAN 106 | EQUAL TO OR LARGER THAN 106 |
| UPPER-LIMIT SHEET COUNT | 2 | 1 |

SHEET POST-PROCESSING APPARATUS THAT PERFORMS BUFFER PROCESSING, AND IMAGE FORMING APPARATUS

BACKGROUND OF THE INVENTION

1. Field of the Invention

The present invention relates to a sheet post-processing apparatus and an image forming apparatus, and more particularly to a sheet post-processing apparatus for performing post-processing, such as formation of a fold line, on a sheet having an image formed thereon.

2. Description of the Related Art

Some sheet post-processing apparatuses provided in image forming apparatuses perform post-processing, such as formation of a fold line, on a sheet having an image formed thereon. The reason why the fold line is formed in the sheet includes the following: (1) The sheet is made easy to be folded in a folding step. (2) Bulging of a folded portion of a saddle-stitched brochure is suppressed. (3) The saddle-stitched brochure is made easy to be opened To form a fold line in a sheet, a so-called scoring apparatus as an example of the sheet post-processing apparatus is employed.

To make a saddle-stitched brochure with less opening by suppressing bulging of a folded portion of the saddle-stitched brochure, there has been proposed a scoring apparatus that scores sheets one by one. In this sheet post-processing apparatus, the scored sheets are stacked on a stacking section, and then a sheet bundle of the stacked sheets is saddle-stitched by a stapler and is folded by a folding roller (see Japanese Patent Laid-Open Publication No. 2008-105316).

By the way, it is difficult to accurately score a sheet during conveyance thereof. Therefore, to accurately score the sheet, it is required to stop conveyance of the sheet once and then score the same.

However, to perform scoring of sheets one by one, as described in Japanese Patent Laid-Open Publication No. 2008-105316, it is impossible, before the scoring of one sheet is completed, to convey a next sheet to the scoring apparatus.

Therefore, when scoring is performed, conveyance of each sheet is once stopped, which causes reduction of productivity of the entire processing.

SUMMARY OF THE INVENTION

The present invention provides sheet post-processing apparatus which cause less reduction of productivity in an image forming process even when post-processing, such as scoring, is performed on sheets, and an image forming apparatus.

In a first aspect of the present invention, there is provided a sheet post-processing apparatus that performs processing on a sheet having an image formed thereon, comprising a post-processing unit configured to perform processing on a sheet and a sheet bundle, an upper limit value of the number of sheets which the post-processing unit is capable of processing at a time being equal to N (N is an integer), a buffer unit configured to perform buffer processing for retaining a conveyed sheet and conveying the retained sheet and at least one following sheet in a state placed one upon another as a sheet bundle, and a control unit configured to control the buffer unit and the post-processing unit such that when the post-processing unit is performing the processing on the sheet or the sheet bundle, the buffer unit performs the buffer processing on a plurality of following sheets not larger in number than the upper limit value N, whereby the processing is performed on each sheet bundle formed by the buffer processing.

In a second aspect of the present invention, there is provided an image forming apparatus comprising a printing unit configured to perform image formation on a sheet, a post-processing unit configured to perform processing on a sheet and a sheet bundle on which the printing unit has performed image formation, an upper limit value of a sheet count of sheets which the post-processing unit is capable of processing at a time being equal to N (N is an integer), a buffer unit configured to perform buffer processing for retaining a conveyed sheet and conveying the retained sheet and at least one following sheet in a state placed one upon another as a sheet bundle, and a control unit configured to control the buffer unit and the post-processing unit such that when the post-processing unit is performing the processing on the sheet or the sheet bundle, the buffer unit performs the buffer processing on a plurality of following sheets not larger in number than the upper limit value N, whereby the processing is performed on each sheet bundle formed by the buffer processing.

According to the present invention, even when post-processing, such as scoring, is performed on sheets, it is possible to prevent reduction of productivity in the image forming process.

Further features of the present invention will become apparent from the following description of exemplary embodiments with reference to the attached drawings.

BRIEF DESCRIPTION OF THE DRAWINGS

FIGS. 5A to 5D are diagrams useful in explaining buffer processing performed by the finisher shown in FIG. 3, in which FIG. 5A shows a state where a first sheet is at rest, FIG. 5B shows a state where the first sheet is guided into a buffer path, FIG. 5C shows a state where the first sheet and a second sheet are placed one on the other, and FIG. 5D shows a state where the first sheet and the second sheet are conveyed as a sheet bundle.

FIGS. 6A to 6C are diagrams useful in explaining scoring performed by the finisher shown in FIG. 3, in which FIG. 6A shows a state where the leading edge of a sheet has been detected by a scoring sensor, FIG. 6B shows a state where the sheet is at rest at a scoring position, and FIG. 6C shows a state where the sheet scored is conveyed again.

FIGS. 8A to 8E are diagrams useful in explaining how a scoring mode is set by the console section appearing in FIG. 7, in which FIG. 8A shows an initial screen, FIG. 8B shows an applied mode selection screen, FIG. 8C shows a scoring setting screen, FIG. 8D shows a sheet feeder-selection screen, and FIG. 8E shows a sheet type selection screen.

FIGS. 10A and 10B are diagrams showing conveyance of sheets to a scoring section in the finisher appearing in FIG. 3, in which FIG. 10A shows conveyance of a sheet set as a non-buffer sheet, and FIG. 10B shows conveyance of a sheet set as a buffer discharge sheet.

FIG. 11 is a diagram showing an example of an upper-limit sheet count table stored in the finisher controller appearing in FIG. 4.

FIGS. 13A to 13C are diagrams useful in explaining punching processing by the finisher appearing in FIG. 12, in which FIG. 13A shows a state where the leading edge of a sheet has been detected by a path sensor, FIG. 13B shows a state where the sheet is at rest at a punching position, and FIG. 13C shows a state where the punched sheet is conveyed again.

FIG. 14 is a diagram showing an example of an upper-limit sheet count table used by the finisher appearing in FIG. 12.

DESCRIPTION OF THE EMBODIMENTS

The present invention will now be described in detail below with reference to the accompanying drawings showing embodiments thereof.

Figure 1:
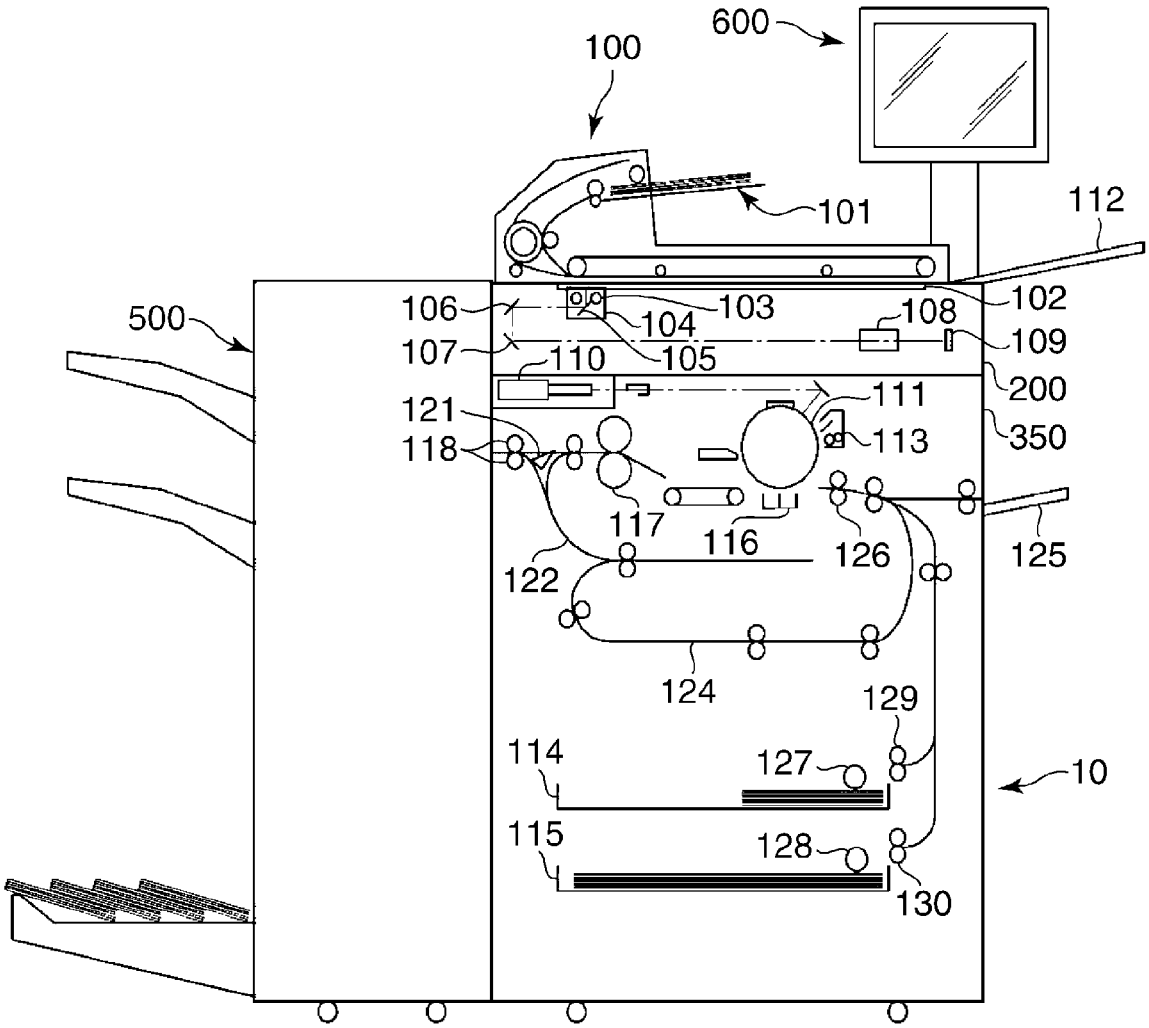
FIG. 1 is a diagram of an image forming apparatus equipped with a sheet post-processing apparatus according to an embodiment of the present invention.

FIG. 1 is a diagram of an example of an image forming apparatus equipped with a sheet post-processing apparatus according to an embodiment of the present invention.

Referring to FIG. 1, the image forming apparatus comprises a main unit (image forming apparatus main unit: printing apparatus) 10 and the sheet post-processing apparatus (finisher) 500. The main unit 10 performs image formation on a sheet according to image data. The main unit 10 includes an image reader 200 which reads an image from an original to obtain image data and a printer 350 which forms an image on a sheet according to the image data.

A document feeder 100 is mounted on a top of the image reader 200. When a bundle of originals are set on a document tray 101 with images for reading facing upward, the document feeder 100 sequentially feeds the originals one by one from the leading page in the left direction, as viewed in FIG. 1. The originals are conveyed via a curved path through a predetermined reading position on a platen glass 102, from left to right. Then, the originals are discharged onto a discharge tray 112.

A scanner unit 104 is fixed to the reading position. As each original passes the reading position on the platen glass 102, an image on the original is read by the scanner unit 104. More specifically, as each original passes the reading position, light is irradiated onto the original from a lamp 103 of the scanner unit 104, and reflected light from the original is guided to a lens 108 via mirrors 105, 106, and 107. Light having passed through the lens 108 forms an image on an image sensor 109.

As described above, as shown in FIG. 1, each original is conveyed so as to pass the reading position from left to right. At this time, scanning is performed to read the original, by setting a direction orthogonal to the conveying direction of the original as the main scanning direction and the conveying direction of the original as the sub scanning direction. More specifically, as each original passes the reading position, an image on the original is read line by line in the main scanning direction by the image sensor 109 while the original is being fed in the sub scanning direction, whereby the original is read.

The original image thus optically read is converted to image data by the image sensor 109 and is then output from the same. The image data output from the image sensor 109 is input as a video signal to an exposure section 110 of the printer 350.

Note that an image on each original may be read by causing the document feeder 100 to stop the conveyed original at a predetermined position on the platen glass 102, and then causing the scanner unit 104 to scan the image from left to right, as viewed in FIG. 1.

To read an original without using the document feeder 100, first, the user lifts the document feeder 100, and then places the original on the platen glass 102. Next, the user causes the scanner unit 104 to scan the original from left to right, as viewed in FIG. 1, to read the original.

The exposure section 110 modulates a laser beam based on the video signal and outputs the same. The laser beam is scanned by a polygon mirror (not shown) to be irradiated onto a photosensitive drum 111, whereby an electrostatic latent image is formed on the photosensitive drum 111 according to the laser beam.

The electrostatic latent image on the photosensitive drum 111 is developed and visualized as a toner image by a developer (toner) supplied from a developing device 113.

On the other hand, the printer 350 includes an upper cassette 114 and a lower cassette 115. One of pickup rollers 127 and 128 picks up a sheet from an associated one of the upper cassette 114 and the lower cassette 115. Then, the sheet is conveyed to a registration roller 126 by an associated one of sheet feed rollers 129 and 130.

When the leading edge of the sheet reaches the registration roller 126, the registration roller 126 is driven in timing synchronous with the start of the irradiation of the laser beam, and the sheet is conveyed (to a transfer position) between the photosensitive drum 111 and a transfer section 116. The toner image formed on the photosensitive drum 111 is transferred onto the sheet at the transfer position.

After that, the sheet is conveyed to a fixing section 117. The fixing section 117 performs fixing processing for fixing the toner image on the sheet. The sheet having passed through the fixing section 117 is discharged from the printer 350 onto the finisher 500 via a flapper 121 and a discharge roller 118.

Here, when the sheet is to be discharged face-down, i.e. with an image-formed surface thereof facing downward, the sheet is once guided to an inversion path 122 by the flapper 121. After the trailing edge of the sheet has left the flapper 121, the sheet is switched back to be discharged from the printer 350 by the discharge roller 118.

The above-described sheet discharge mode is referred to as "inverted discharge". This inverted discharge is used in a case where images are sequentially formed starting with the leading page of the sheet bundle. The sheets discharged by the inverted discharge are stacked in the correct page order. Note that the inverted discharge is employed in a case where image formation is performed based on image data obtained by reading images from originals using the document feeder 100 or received from an external computer.

To perform image formation on a hard sheet, such as an OHP (overhead projector) sheet, fed from a manual sheet feeder 125, the sheet is not guided into the inversion path 122. In this case, the sheet is discharged from the discharge roller 118 face-up, i.e. with an image-formed surface thereof facing upward.

In the case of double-sided printing in which images are formed on both sides of a sheet, the sheet is guided into the inversion path 122 by the flapper 121. Then, the sheet is conveyed to a double-sided conveying path 124 by the flapper 121, and is sent to the transfer position via the double-sided conveying path 124 in the above-described timing again.

Figure 2:
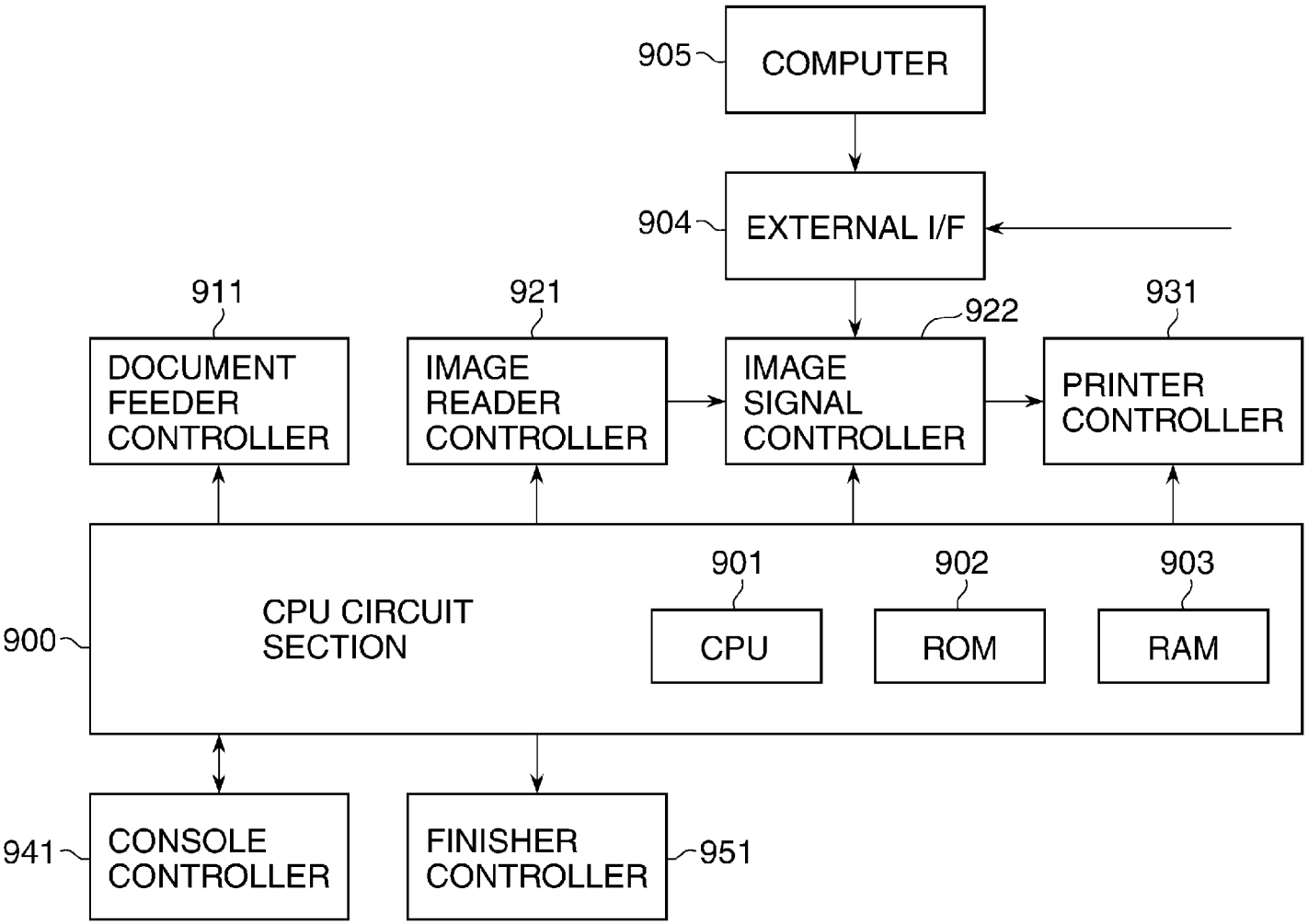
FIG. 2 is a block diagram showing an example of a control system of the image forming apparatus shown in FIG. 1.

FIG. 2 is a block diagram showing an example of a control system of the image forming apparatus shown in FIG. 1.

The control system includes a CPU circuit section 900. The CPU circuit section 900 comprises a CPU 901, a ROM 902, and a RAM 903. The CPU 901 is connected to the ROM 902 and the RAM 903 by an address bus and a data bus (none of which are shown).

The ROM 902 stores control programs. The CPU 901 controls the overall basic operation of the image forming apparatus according to the control programs. More specifically, the CPU 901 controls the overall operation of a document feeder controller 911, an image reader controller 921, an image signal controller 922, a printer controller 931, a console controller 941, and a finisher controller 951 (determination unit) according to the control programs. The RAM 903 temporarily stores control data, and is further used as a work area for carrying out arithmetic operations involved in control processing.

The document feeder controller 911 drivingly controls the document feeder 100 under the control of the CPU 901. The image reader controller 921 drivingly controls the scanner unit 104 and the image sensor 109, etc. and transfers an image signal (analog signal) delivered from the image sensor 109 to the image signal controller 922.

The image signal controller 922 converts the image signal to a digital signal, and then performs various kinds of processing on the digital signal to convert the processed digital signal to image data. Then, the image signal controller 922 converts the image data to a video signal, and delivers the video signal to the printer controller 931.

As shown in FIG. 2, a computer 905 is connected to the image signal controller 922 via an external interface 904. Upon receipt of a digital image signal from the computer 905 via the external interface 904, the image signal controller 922 performs various kinds of processing on the digital image signal to convert the processed digital image signal to image data. Then, the image signal controller 922 converts the image data to a video signal, and delivers the video signal to the printer controller 931. Note that the image signal controller 922 performs the processing under the control of the CPU 901.

The printer controller 931 controls the exposure section 110 and the printer 350 based on the video signal, and performs image formation control and sheet conveyance control, as described above.

The finisher controller 951 is mounted on the finisher 500 illustrated in FIG. 1. The finisher controller 951 communicates with the CPU 901 to drivingly control the finisher 500. Note that control performed by the finisher controller 951 will be described hereinafter.

The console controller 941 controls a console section 600 under the control of the CPU 901. As shown in FIG. 1, the main unit 10 has the console section 600 mounted thereon. The console section 600 includes a plurality of keys for configuring various functions for image formation, and a display section for displaying information indicative of settings of the functions. The console controller 941 sends key signals corresponding to respective key operations to the CPU 901. Further, the console controller 941 displays information indicated by a display control signal sent from the CPU 901 according to the signal on the console section 600.

Figure 3:
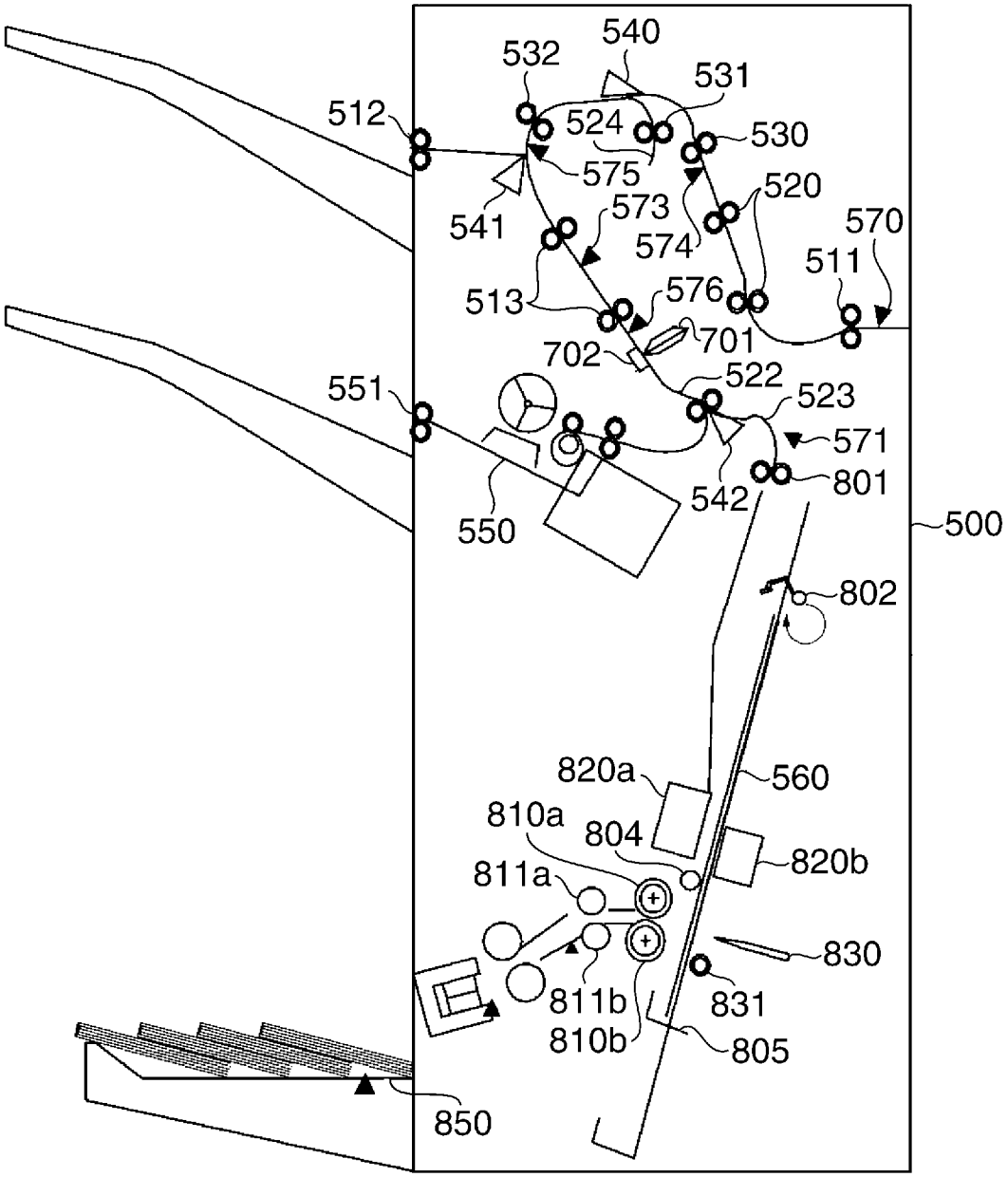
FIG. 3 is a diagram of a finisher shown in FIG. 1.

FIG. 3 shows the arrangement of the finisher 500 appearing in FIG. 1.

The finisher 500 sequentially takes in sheets discharged from the main unit 10, and performs post-processing on a plurality of sheets. Examples of the post-processing include processing for aligning the taken-in sheets into a bundle, staple processing for stapling the trailing edges of the bundled sheets, and bookbinding processing for folding the sheet bundle in two at the center thereof and bookbinding the same.

The finisher 500 includes an inlet roller pair 511, and takes in a sheet discharged from the main unit 10 by the inlet roller pair 511. The sheet taken in by the inlet roller pair 511 is conveyed by conveying roller pairs 520, 530, 532, and 513.

A switching flapper 540 is disposed between the conveying roller pairs 530 and 532. The switching flapper 540 is used for guiding a sheet inverted and conveyed by the conveying roller pair 532 into a buffer path 524 (buffer unit). Further, the switching flapper 540 is used for guiding a sheet conveyed by the conveying roller pair 530 to the conveying roller pair 532.

Arranged downstream of the conveying roller pair 532 are a scoring blade 701 which performs processing for scoring a sheet, a scoring blade receiving member 702, and a switching flapper 541. Further, a scoring sensor 576 for detecting a sheet is disposed upstream of the scoring blade 701. The switching flapper 541 switches a conveying destination of a sheet between a conveying path extending up to the discharge tray and a discharge path 522. Further, a switching flapper 542 is disposed downstream of the discharge path 522, and switches a conveying destination of a sheet between a processing tray 550 and a bookbinding path 523.

The sheet guided into the bookbinding path 523 is conveyed to a bookbinding processing tray 560 by a conveying roller pair 801. A bookbinding inlet sensor 571 is disposed at an intermediate location of the bookbinding path 523. In the bookbinding processing tray 560, there are provided a sheet holding member 802, a sheet positioning member 804 of a movable type, and a leading edge-aligning member 805.

An anvil **820*b* is provided at a location opposed to a stapler 820*a*. The stapler 820*a* cooperates with the anvil 820*b* to perform staple processing on a sheet bundle P received in the bookbinding processing tray 560**.

Folding rollers **810*a* and 810*b* and a thrusting member 830 are disposed downstream of the stapler 820*a*. The thrusting member 830 is disposed at a location opposed to the folding rollers 810*a* and 810*b*. When the thrusting member 830 is caused to protrude toward the sheet bundle P received in the bookbinding processing tray 560, the sheet bundle P is pushed between the folding rollers 810*a* and 810*b*. The folded sheet bundle P is passed to folding conveying rollers 811*a* and 811*b* by the folding rollers 810*a* and 810*b*, to be discharged onto a bookbinding tray 850**.

Figure 4:
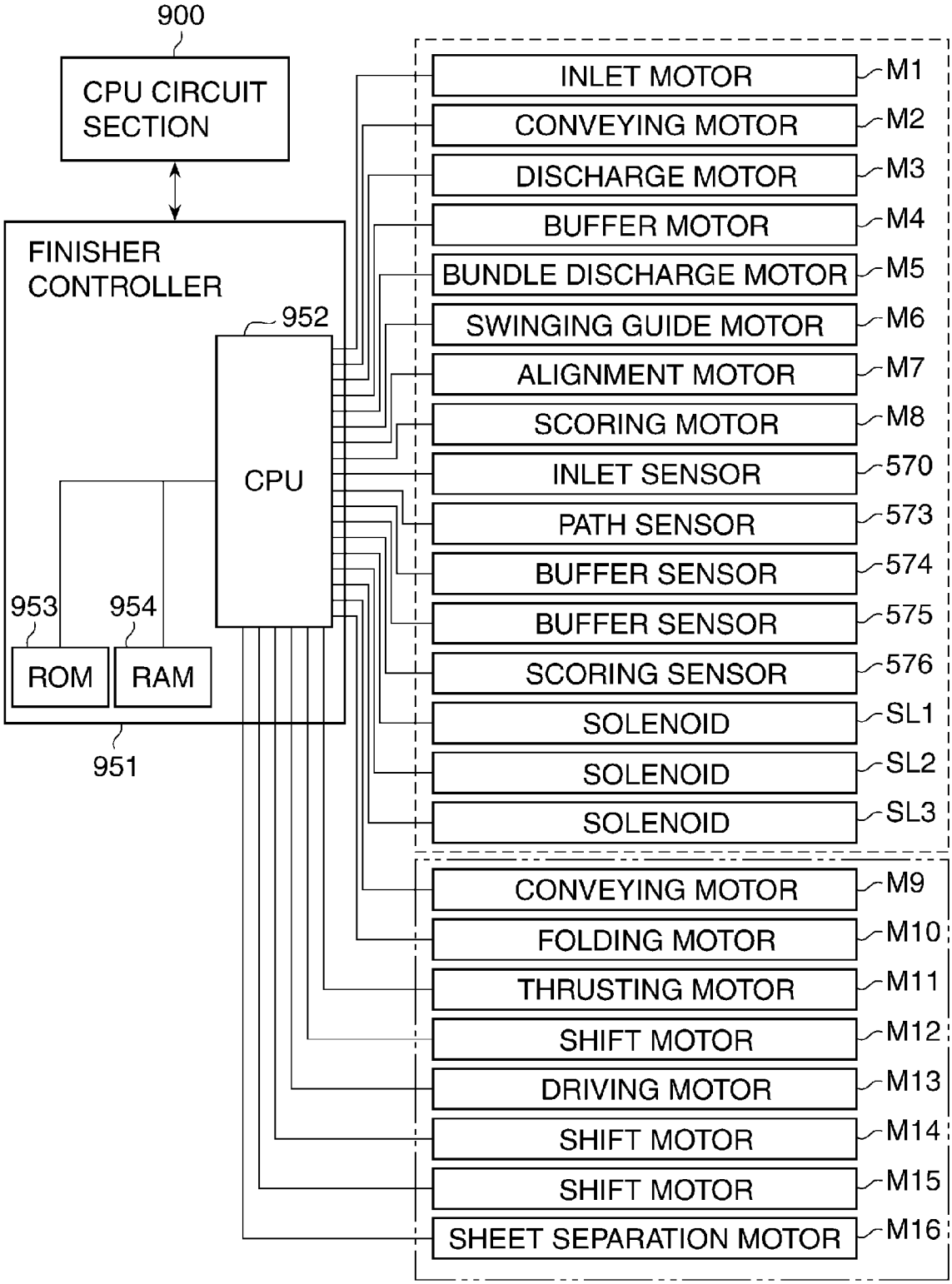
FIG. 4 is a block diagram useful in explaining a finisher controller that drivingly controls the finisher shown in FIG. 3.

FIG. 4 is a block diagram useful in explaining the finisher controller 951 for drivingly controlling the finisher 500 shown in FIG. 3.

Referring to FIG. 4, the finisher controller 951 comprises a CPU 952 (determination unit), a ROM 953 (storage unit), and a RAM 954. The finisher controller 951 communicates with the CPU circuit section 900 provided in the main unit 10 via a communication IC (integrated circuit: not shown). Further, the finisher controller 951 drivingly controls the finisher 500 by executing various programs stored in the ROM 953 according to instructions from the CPU circuit section 900.

As shown in FIG. 4, the finisher 500 includes an inlet motor M1 for driving the inlet roller pair 511 and the conveying roller pairs 520, a conveying motor M2 for driving the conveying roller pair 530, a discharge motor M3 for driving a discharge roller pair 512 and the conveying roller pairs 513, and a buffer motor M4 for driving a buffer roller pair 531 and the conveying roller pairs 532.

Further, the finisher 500 also includes a bundle discharge motor M5 for driving a bundle discharge roller 551, a swinging guide motor M6 for lifting up and down a swinging guide (not shown), an alignment motor M7 for driving alignment members (not shown), and a scoring motor M8 for driving the scoring blade 701.

Note that an inlet sensor 570, a path sensor 573, a buffer sensor 574, a buffer sensor 575, and the scoring sensor 576 are connected to the CPU 952, each for detecting passage of a sheet.

In addition, the finisher 500 includes a solenoid SL1 for driving the switching flapper 540, a solenoid SL2 for driving the switching flapper 541, and a solenoid SL3 for driving the switching flapper 542.

Further, the finisher 500 includes a conveying motor M9 for driving the conveying roller pair 801, a folding motor M10 for driving the folding rollers 810*a* and 810*b*, a thrusting motor M11 for driving the thrusting member 830, a shift motor M12 for separating the sheet positioning member 804 from the bookbinding processing tray 560 or bringing the sheet positioning member 804 into contact with the bookbinding processing tray 560, a driving motor M13 for driving the sheet holding member 802, a shift motor M14 for causing the sheet holding member 802 to shift according to the sheet size of a sheet, a shift motor M15 for causing the leading edge-aligning member 805 to shift, and a sheet separation motor M16 for driving a sheet separation roller 831.

Next, a description will be given of buffer processing (buffering) performed by the finisher 500.

The buffer processing is performed for temporarily retaining a sheet conveyed from the main unit 10 on a conveying path to convey the sheet and the following sheet in a state placed one on the other. During a post-processing operation, such as a stapling operation or a scoring operation, the buffer processing is performed when a sheet cannot be conveyed to a stapling section or a scoring section (each corresponding to a post-processing unit). After termination of the post-processing operation, a sheet bundle having undergone the buffer processing is conveyed. By performing the buffer processing, it is possible to prevent image formation by the main unit 10 from being suspended even during the post-processing operation.

Figure 5A:
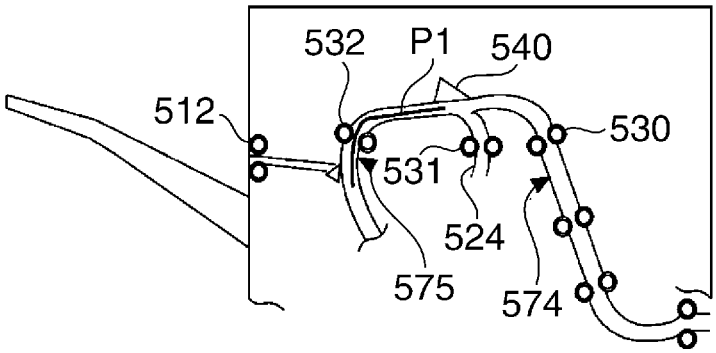
Figure 5B:
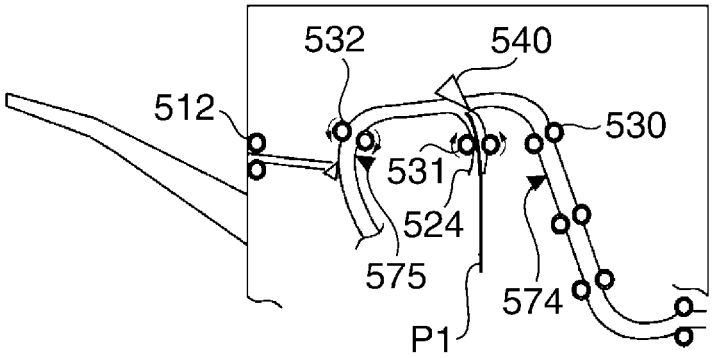
Figure 5C:
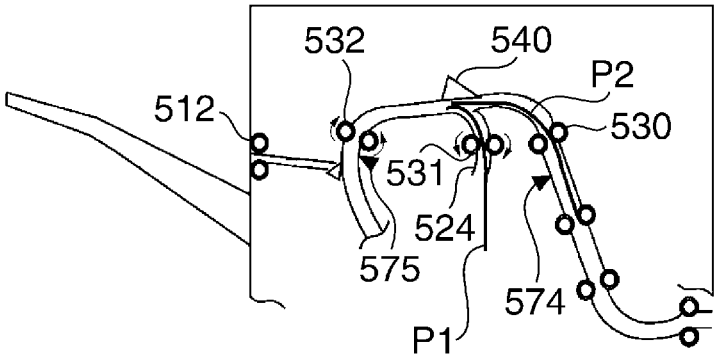
Figure 5D:
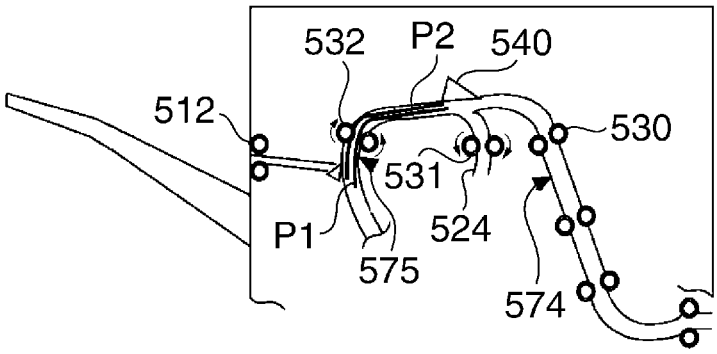

FIGS. 5A to 5D are diagrams useful in explaining buffer processing performed by the finisher 500 shown in FIG. 3, in which FIG. 5A shows a state where a first sheet P1 is at rest, FIG. 5B shows a state where the first sheet P1 is guided into the buffer path 524, FIG. 5C shows a state where the first sheet P1 and a second sheet P2 are placed one on the other, and FIG. 5D shows a state where the first sheet P1 and the second sheet P2 are conveyed as a sheet bundle. Note that the first sheet P1 and the second sheet P2 are placed one on the other such that the position of the leading edge of the first sheet P1 and the position of the leading edge of the second sheet P2 coincide with each other. In short, the leading edges of respective sheets of a sheet bundle P coincide with each other in position.

When the buffer sensor 575 detects a sheet P1 as a first page discharged from the main unit 10, the CPU 952 stops the sheet P1 at a position a predetermined distance away from the buffer sensor 575 (see FIG. 5A).

Next, the CPU 952 operates the solenoid SL1 to switch the switching flapper 540 such that the sheet P1 is guided into the buffer path 524. Then, the CPU 952 drives the buffer motor M4 for reverse rotation to drive the buffer roller pair 531 and the conveying roller pairs 532 for reverse rotation. This causes the CPU 952 to guide the sheet P1 into the buffer path 524 (see FIG. 5B).

After driving the buffer motor M4 for reverse rotation by a predetermined amount, the CPU 952 stops the buffer motor M4 to cause the sheet P1 to wait (to be retained) in the buffer path 524.

Then, the CPU 952 drives the solenoid SL1 to switch the position of the switching flapper 540 such that the sheet P1 is guided to the conveying roller pairs 532. When a predetermined time period has elapsed after detection of the leading edge of a sheet P2 as the next page, following the sheet P1, by the buffer sensor 574, in other words, when the sheet P2 has advanced over a predetermined distance, the CPU 952 drives the buffer motor M4. As a consequence, the CPU 952 drives the buffer roller pair 531 and the conveying roller pairs 532 for rotation to superimpose the sheet P2 on the sheet P1 (see FIG. 5C). The sheet P1 and the sheet P2 placed one on the other are conveyed as a sheet bundle of two sheets (see FIG. 5D).

Next, a description will be given of scoring performed by the finisher 500 shown in FIG. 3.

Figure 6A:
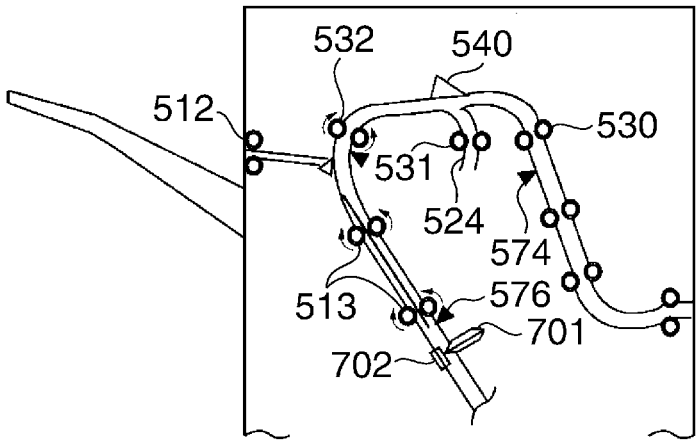
Figure 6B:
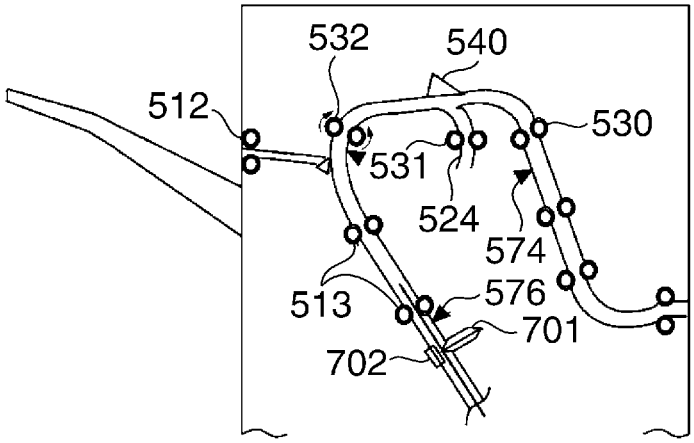
Figure 6C:
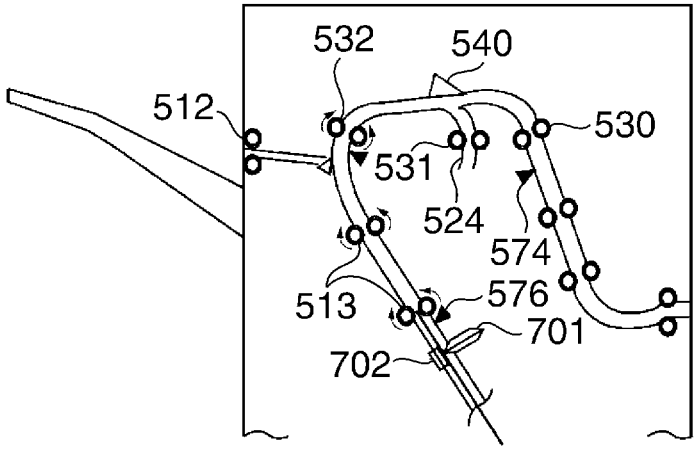

FIGS. 6A to 6C are diagrams useful in explaining scoring performed by the finisher 500 shown in FIG. 3, in which FIG. 6A shows a state where the leading edge of a sheet has been detected by the scoring sensor 576, FIG. 6B shows a state where the sheet is at rest at a scoring position, and FIG. 6C shows a state where the scored sheet is conveyed again. Note that the term "scoring" is intended to mean processing for forming a fold line in a sheet so as to perform accurate positioning of a folding position of the sheet to improve the quality of a folded portion of the sheet, and is an example of the post-processing.

When the leading edge of the sheet is detected by the scoring sensor 576 (see FIG. 6A), the CPU 952 conveys the sheet for a predetermined time period, i.e. over a predetermined distance, and then stops the conveying roller pairs 513 (see FIG. 6B). Next, the CPU 952 slides the scoring blade 701 on the sheet in a sheet width direction (direction orthogonal to a sheet conveying direction) to form a fold line on the sheet.

After the operation of the scoring blade 701 has been terminated, the CPU 952 drives the conveying roller pairs 513 to convey the sheet to the processing tray 550 or the bookbinding path 523 (see FIG. 6C).

Figure 7:
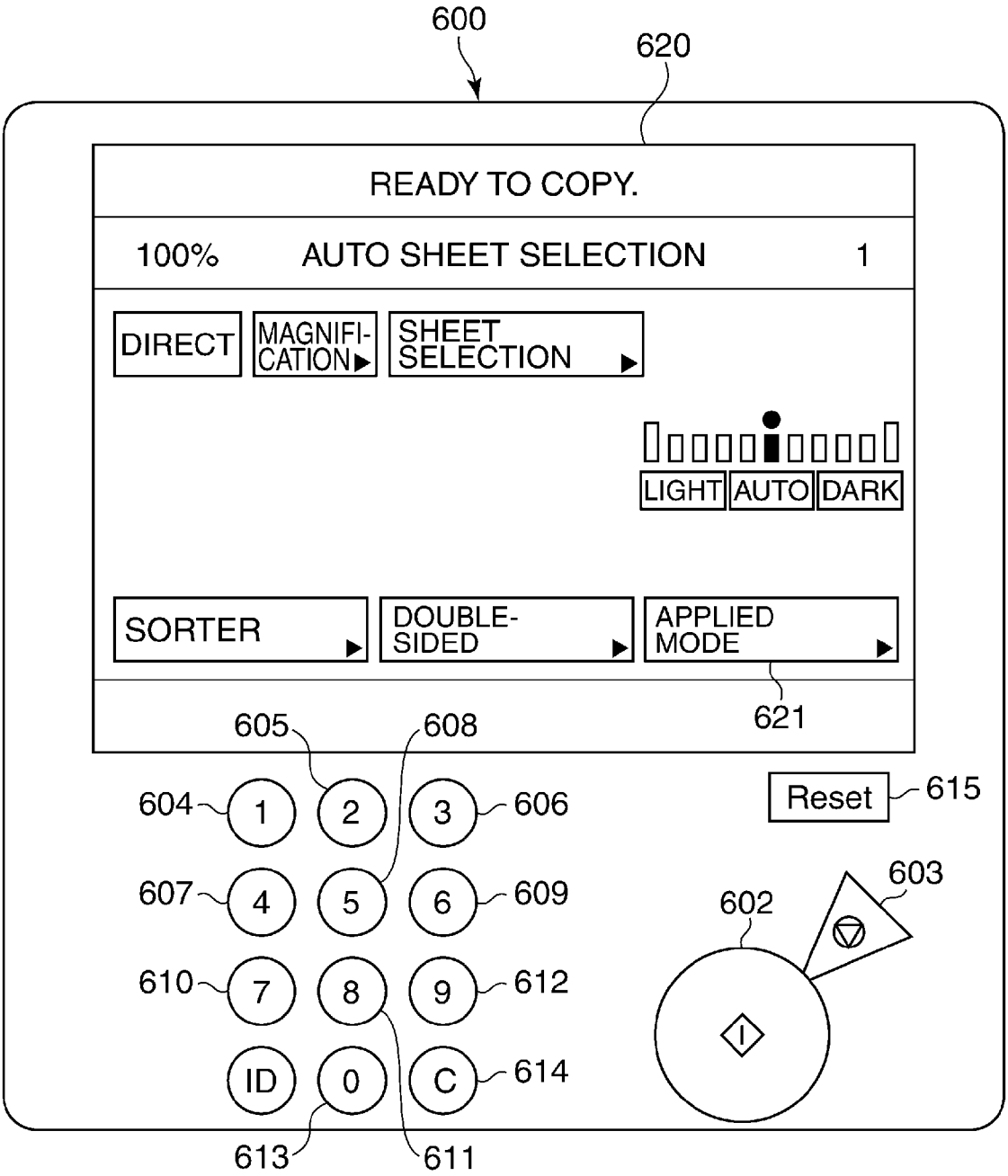
FIG. 7 is a diagram showing an example of a console section appearing in FIG. 1.

FIG. 7 is a diagram showing an example of the console section 600 appearing in FIG. 1.

The console section 600 comprises a start button 602, a stop key 603, ten keys 604 to 613, a clear key 614, and a reset key 615. Further, the console section 600 includes a display section 620 which has a touch panel, an applied mode key 621, and so forth arranged on a surface thereof.

The start button 602 is operated at the start of an image forming operation. The stop key 603 is operated when the image forming operation is suspended. The ten keys 604 to 613 are used e.g. when numerical values are entered for setting.

Figure 8A:
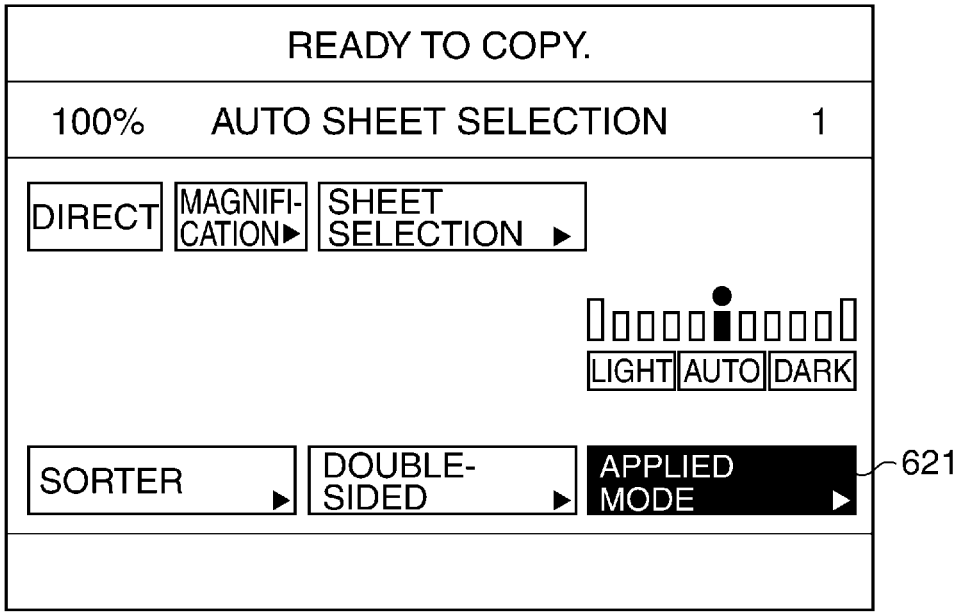
Figure 8B:
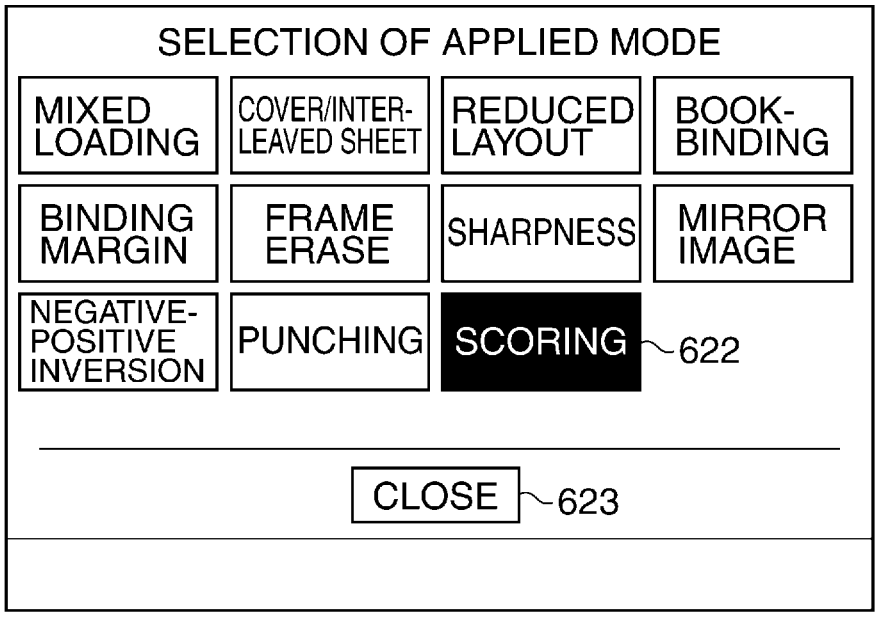
Figure 8C:
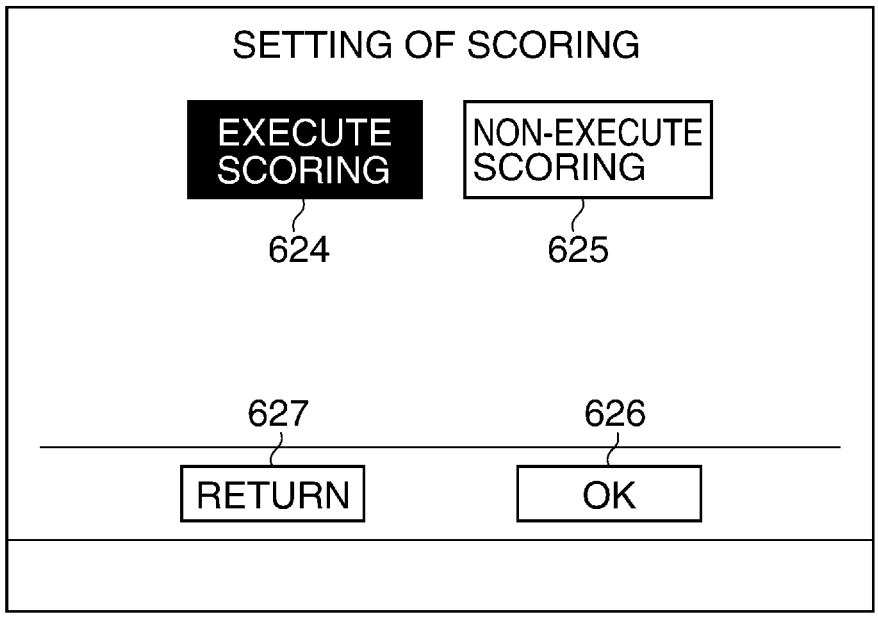
Figure 8D:
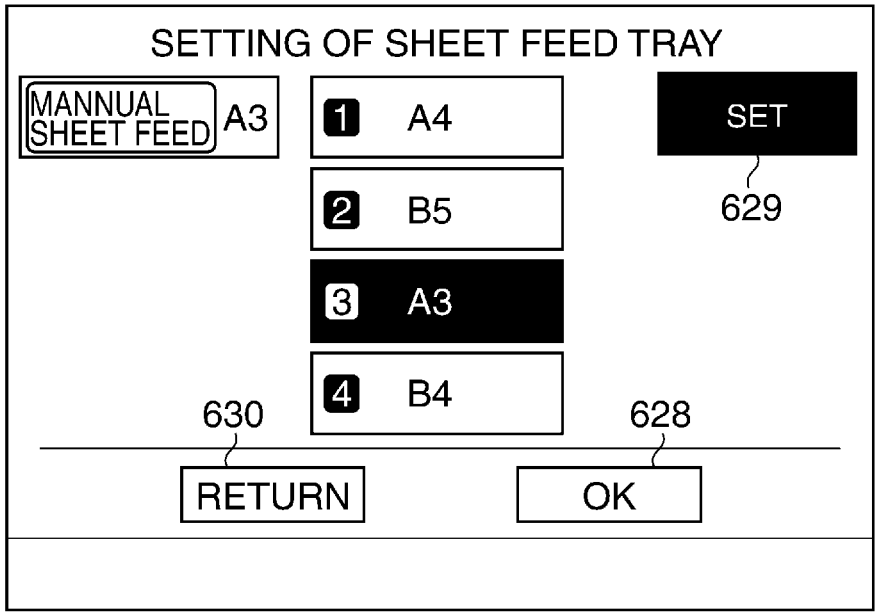
Figure 8E:
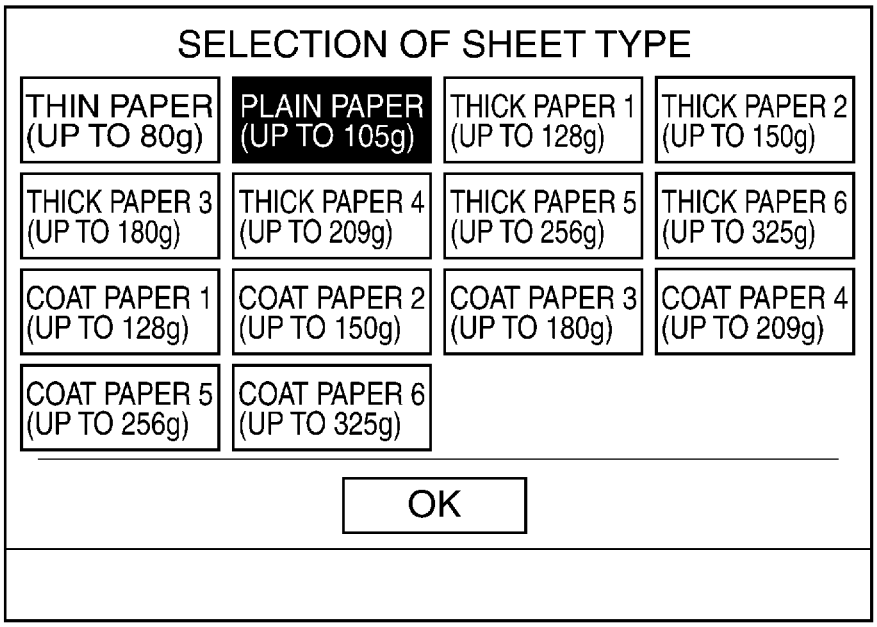

FIGS. 8A to 8E are diagrams useful in explaining how a scoring mode is set by the console section 600 appearing in FIG. 7, in which FIG. 8A shows an initial screen, FIG. 8B shows an applied mode selection screen, FIG. 8C shows a scoring setting screen, FIG. 8D shows a sheet feeder-selection screen, and FIG. 8E shows a sheet type selection screen.

Now, let it be assumed that the user sets a bookbinding mode from the console section 600. In this case, when the user depresses the "applied mode" key 621, which is a soft key, on the initial screen appearing in FIG. 8A, the CPU 901 (FIG. 2) causes the console controller 941 to display the applied mode selection screen shown in FIG. 8B on the display section 620.

When the user depresses a "scoring" key 622 on the applied mode selection screen, the CPU 901 causes the console controller 941 to display the scoring setting screen shown in FIG. 8C on the display section 620. Note that when the user depresses a "close" key 623 on the applied mode selection screen, the CPU 901 causes the console controller 941 to display the initial screen on the display section 620.

When the sheet is to be scored, the user depresses a "execute scoring" key 624 on the scoring setting screen, whereas when the sheet is not to be scored, the user depresses a "inhibit scoring" key 625 on the scoring setting screen.

When the user depresses an "OK" key 626 on the scoring setting screen after depressing the "execute scoring" key 624, the CPU 901 causes the console controller 941 to display the sheet feeder-selection screen shown in FIG. 8D on the display section 620. On the other hand, when the user depresses the "OK" key 626 after depressing the "inhibit scoring" key 625, the CPU 901 completes the settings of the scoring mode.

Note that when the user depresses a "return" key 627 on the scoring setting screen, the CPU 901 controls the console controller 941 to display the applied mode selection screen shown in FIG. 8B on the display section 620.

When the user depresses an "OK" key 628 on the sheet feeder-selection screen after selecting a sheet feed tray, the CPU 901 completes the settings of the scoring mode. On the other hand, when the user depresses a "set" key 629 after selecting a sheet feed tray, the CPU 901 causes the console controller 941 to display the sheet type selection screen shown in FIG. 8E on the display section 620.

When the user depresses a "return" key 630 on the sheet feeder-selection screen, the CPU 901 causes the console controller 941 to display the scoring setting screen appearing in FIG. 8C on the display section 620.

When the user depresses an "OK" key 631 on the sheet type selection screen after setting a sheet type for the sheet feed tray selected on the sheet feeder-selection screen, the CPU 901 causes the console controller 941 to display the sheet feeder-selection screen appearing in FIG. 8D on the display section 620. Then, when the user depresses the "OK" key 628 on the sheet feeder-selection screen, the CPU 901 completes the settings of the scoring mode.

After completion of the settings of the scoring mode, when the user depresses the start button 602 appearing in FIG. 7, image formation is started to perform scoring processing.

When the scoring mode is thus set, the finisher controller 951 performs buffer sheet-setting processing for setting a sheet as a non-buffer sheet, a buffer sheet, or a buffer discharge sheet, according to the sheet information. The buffer sheet is conveyed into the buffer path 524. The non-buffer sheet is conveyed without being placed on another. The buffer discharge sheet is a finally-placed one of a plurality of sheets placed one upon another. The non-buffer sheet and the buffer discharge sheet are not conveyed into the buffer path 524.

Figure 9:
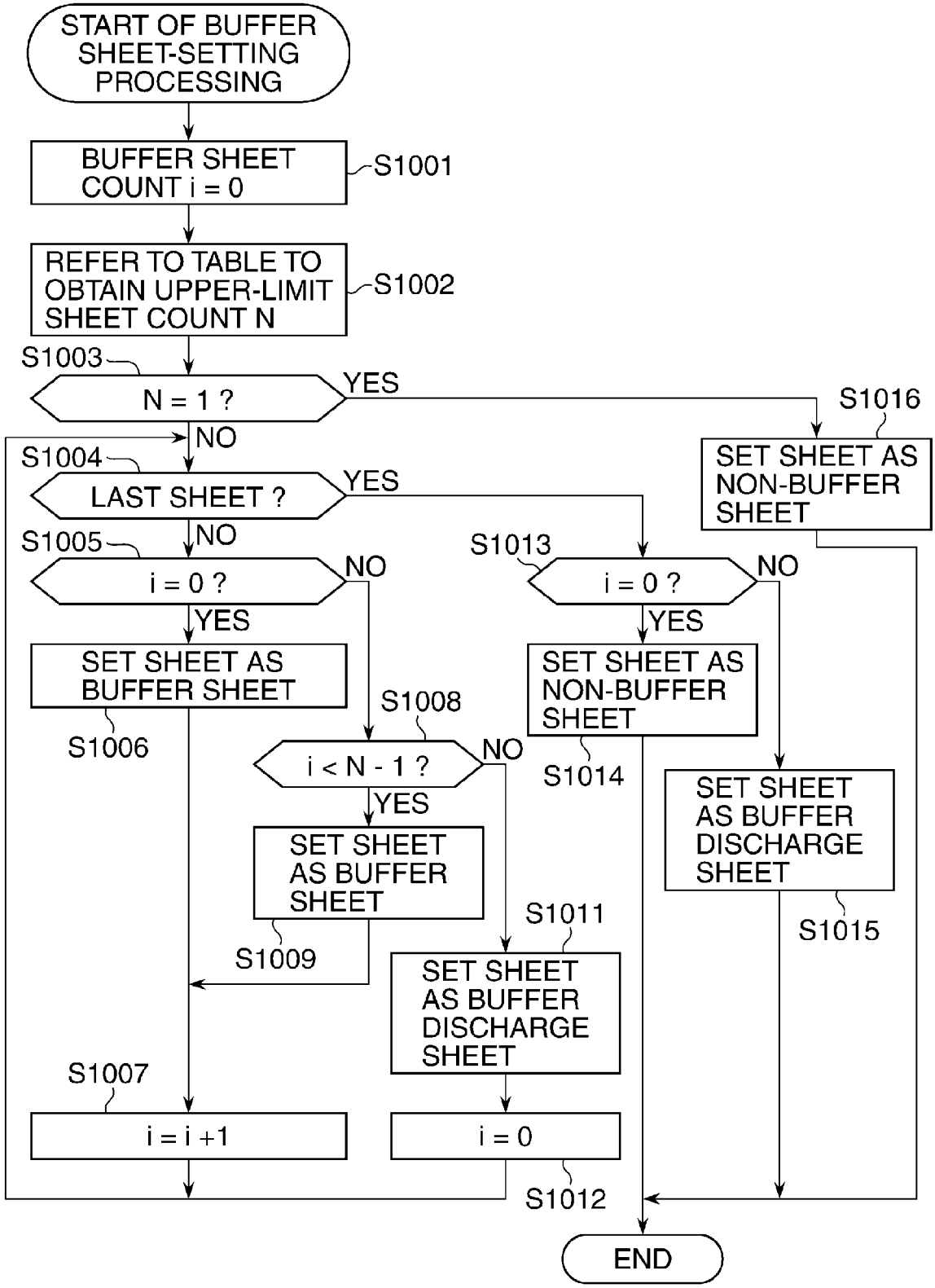
FIG. 9 is a flowchart of buffer sheet-setting processing performed by the finisher controller appearing in FIG. 4.

FIG. 9 is a flowchart of the buffer sheet-setting processing performed by the finisher controller 951 appearing in FIG. 4. FIGS. 10A and 10B are diagrams showing conveyance of sheets to the scoring section of the finisher 500 shown in FIG. 3, in which FIG. 10A shows conveyance of a sheet set as the non-buffer sheet, and FIG. 10B shows conveyance of a sheet set as the buffer discharge sheet.

The sheet set as the non-buffer sheet (first sheet) is conveyed to the scoring section without being caused to wait in the buffer path (see FIG. 10A).

A sheet set as the buffer sheet (second sheet) is caused to wait in the buffer path 524, as described with reference to FIG. 5B. When another sheet is already waiting in the buffer path 524, the sheet is placed on the waiting sheet, as described above, and the sheets placed one upon the other are caused to wait in the buffer path 524.

The sheet set as the buffer discharge sheet (third sheet) is placed on waiting sheets in the buffer path 524, as described with reference to FIG. 5C, and is then conveyed to the scoring section as a sheet bundle, on a sheet bundle basis (see FIG. 10B). In short, the buffer discharge sheet is finally placed on the waiting sheets to form a sheet bundle in the buffer processing.

When the buffer sheet-setting processing is started, first, the CPU 952 initializes a register variable i indicative of a buffer sheet count to 0 (step S1001). The term "buffer sheet count" is intended to mean the number of sheets each having been set as the buffer sheet at a time point when the buffer sheet-setting processing has been performed up to a sheet immediately before a sheet to be subjected to the buffer sheet-setting processing. Therefore, a buffer sheet count when a first sheet is to be subjected to the buffer sheet-setting processing is 0. In other words, the term "buffer sheet count" is intended to mean the number of sheets which should have been retained in the buffer path 524 at a time point when the sheet to be set is conveyed to a location upstream of the buffer path 524, and the upper limit value thereof is equal to a value smaller by 1 than an upper-limit sheet count. Further, the term "upper-limit sheet count" is intended to mean information indicative of the maximum number of sheets that can be placed one upon another (stacked) for post-processing, and the minimum value thereof is equal to 1. That is, the sheet post-processing apparatus performs post-processing on a sheet bundle of sheets the number of which is not larger than the upper-limit sheet count. Then, the CPU 952 acquires the upper-limit sheet count N from an upper-limit sheet count table based on a sheet type set by the user (step S1002).

FIG. 11 is a diagram showing an example of the upper-limit sheet count table stored in the finisher controller 951 appearing in FIG. 4.

The illustrated upper-limit sheet count table is stored in the ROM 953, for example. The table sets a relationship between the types of sheets and upper-limit sheet counts.

Specifically, in the upper-limit sheet count table, each upper-limit sheet count is set according to a sheet basis weight ($g/mm^2$). As shown in FIG. 11, when the sheet basis weight is smaller than 64 ($g/mm^2$), the upper-limit sheet count is set to 3. That is, the scoring section can score a sheet bundle of three sheets placed one upon another. When the sheet basis weight is not smaller than 64 and smaller than 129 ($g/mm^2$), the upper-limit sheet count is set to 2, and when the sheet basis weight is not smaller than 129 ($g/mm^2$), the upper-limit sheet count is set to 1. Here, the sheet basis weights are rounded off to integers.

Next, the CPU 952 determines whether or not the upper-limit sheet count N is equal to 1 (step S1003). If the upper-limit sheet count N is not equal to 1 (NO to the step S1003), i.e. in a case of placing a plurality of sheets one upon another by the buffer processing and then performing scoring on these sheets, the CPU 952 determines whether or not the sheet to be subjected to the buffer sheet-setting processing is the last one of the sheets (step S1004). This determination is performed according to a printing sheet count set by the user.

If it is determined that the sheet to be subjected to the buffer sheet-setting processing is not the last one of the sheets (NO to the step S1004), the CPU 952 determines whether or not the buffer sheet count i is equal to 0 (step S1005). If i=0 holds (no sheet is retained) (YES to the step S1005), the CPU 952 sets the sheet as a buffer sheet (step S1006), adds 1 to the buffer sheet count i (step S1007), and returns to the step S1004.

If the buffer sheet count i is not equal to 0, i.e. if one or more sheets are retained in the buffer path 524 (YES to the step S1005), the CPU 952 compares the buffer sheet count i with the upper-limit sheet count N, and determines whether or not the buffer sheet count i<a processable sheet count (N−1) holds (step S1008). If i<N−1 holds (the buffer sheet count is smaller than a sheet count which is smaller by one than the upper-limit sheet count) (YES to the step S1008), the CPU 952 sets the sheet as a buffer sheet (S1009), adds 1 to the buffer sheet count i (step S1007), and returns to the step S1004.

If i=N−1 (a sheet count smaller by one than the upper-limit sheet count) (NO to the step S1008), the CPU 952 sets the sheet as a buffer discharge sheet (S1011), then initializes the buffer sheet count i to 0 (step S1012), and returns to the step S1004.

If it is determined that the sheet to be subjected to the buffer sheet-setting processing is the last one of the sheets (YES to the step S1004), the CPU 952 determines whether or not the buffer sheet count i is equal to 0 (step S1013). If i=0 holds (YES to the step S1013), there is no waiting sheet in the buffer path 524, so that the CPU 952 sets the last sheet as the non-buffer sheet (step S1014), and terminates the buffer sheet-setting processing of the sheet.

If i is not equal to 0 (NO to the step S1013), there is a waiting sheet in the buffer path 524, so that the CPU 952 sets the last sheet as the buffer discharge sheet (step S1015), and terminates the buffer sheet-setting processing of the sheet.

If N=1 holds in the step S1003 (YES to the step S1003), i.e. if scoring is performed on the sheets one by one without performing buffer processing, the CPU 952 sets the sheet to be subjected to the buffer sheet-setting processing as the non-buffer sheet (S1016), and terminates the buffer sheet-setting processing of the sheet.

For example, let it be assumed that when a job is performed in which five original sheets are subjected to single-sided printing and scoring processing, image formation is set to be performed on sheets having a sheet basis weight of 105 g/mm$^2$. In this case, since the upper-limit sheet count is two from the upper-limit sheet count table shown in FIG. 11, first and third sheets are each set as the buffer sheet. Further, second and fourth sheets are each set as the buffer discharge sheet, and a fifth sheet is set as the non-buffer sheet.

As a consequence, the first and second sheets are placed one on the other, and the third and fourth sheets are placed one on the other, whereby the scoring processing is performed on sheet bundles each formed by 2 sheets. Further, the fifth sheet is singly subjected to the scoring processing. Note that in this case, the sheet discharge interval (sheet feeding interval) of the fourth sheet and the fifth sheet discharged from the image forming apparatus can be increased by a time period required for scoring the third and fourth sheets. Therefore, information of the upper-limit sheet count for scoring, which is dependent on the sheet basis weight of the sheets, is sent in advance from the finisher controller 951 to the CPU circuit section 900.

Although in the above described example, the description has been given of the case where one set, formed by a plurality of sheets, is printed and scored, by way of example, the present embodiment can also be applied to a case where a plurality of sets of sheets are printed. Irrespective of whether the number of sets of sheets is single or plural, it is not specifically required to subject a first sheet to the buffer processing since it has no preceding sheet, but in the illustrated example, for simplification of the control, the first sheet is also subjected to the buffer processing.

Further, if the upper-limit sheet count is one, all sheets are each set as the non-buffer sheet, and if the current sheet to be subjected to the buffer sheet-setting processing is the last one of the sheets, the buffer sheet-setting processing is terminated. In this case, since the upper-limit sheet count is one, the sheet discharge interval of sheets from the image forming apparatus can be increased by a time period required for scoring each sheet. This prevents a sheet being scored from being hit by the following sheet.

Further, when a plurality of sets of sheets are printed, to perform scoring (post-processing) of a first set, a sheet interval e.g. between the first page of a second set and the last page of the first set is made larger. Although this more or less reduces productivity, this reduction of productivity is very small when considered from the viewpoint of whole processing.

As described above, the buffer processing is performed using the upper-limit sheet count as an upper limit, to thereby perform scoring processing in units of a buffered sheet bundle. By performing, during scoring a preceding sheet (sheet bundle), buffer processing on a following sheet, it is possible to perform scoring without suspending image formation. As a consequence, since it is not required to suspend image formation during the scoring, reduction of productivity in the image forming process can be prevented.

Although in the above described embodiment, the description has been given of scoring as the sheet post-processing for determining a buffer sheet count according to the upper-limit sheet count, by way of example, the present embodiment can also be applied to punching processing for punching holes in a sheet, in place of scoring.

Figure 12:
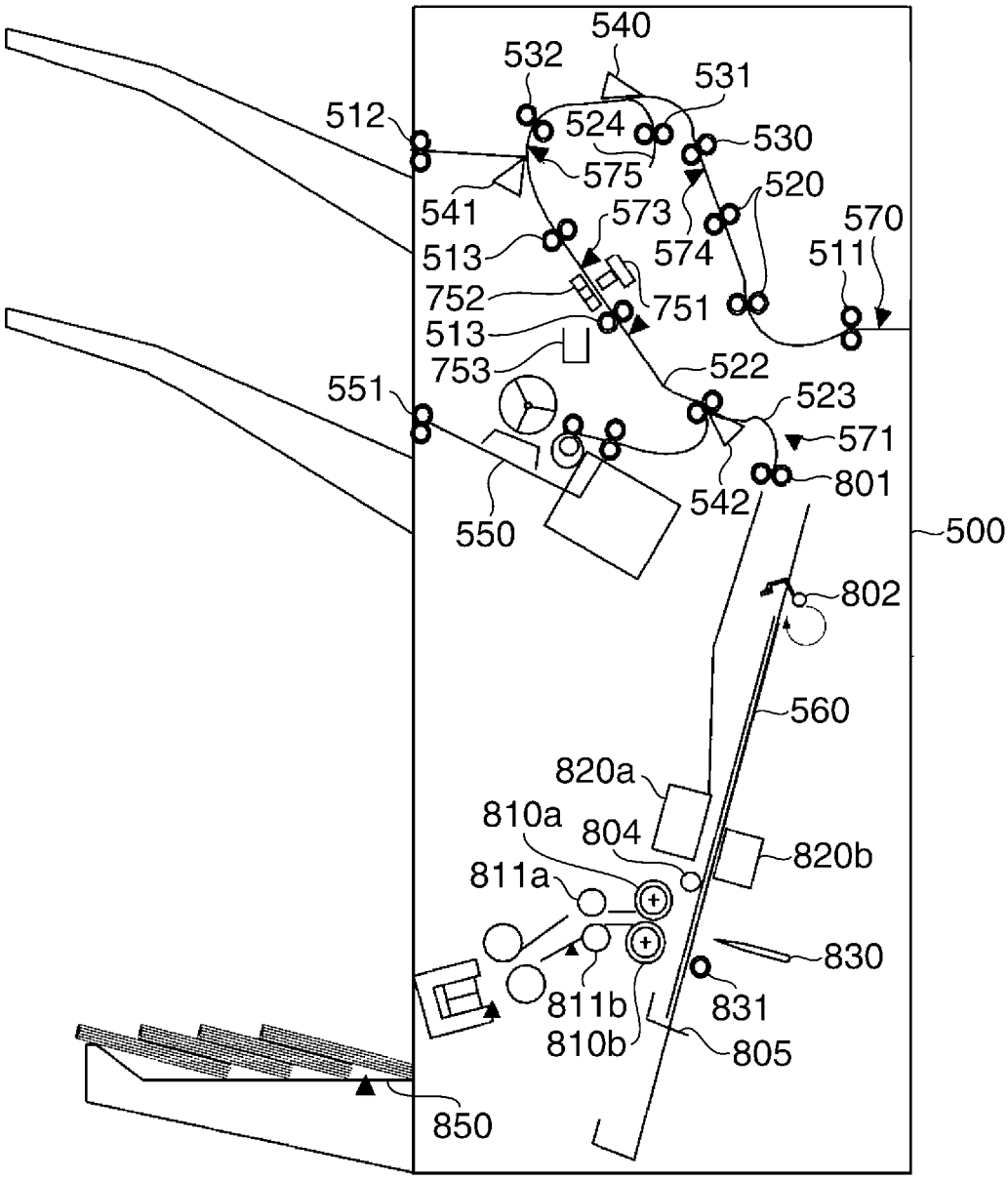
FIG. 12 is a diagram of a variation of the first embodiment in which the finisher appearing in FIG. 1 is configured to have a punch.

FIG. 12 is a diagram of a variation of the first embodiment in which the finisher 500 appearing in FIG. 1 is configured to have a punch. Note that in FIG. 12, the same component elements as appearing in FIG. 3 are denoted by the same reference numerals, and description thereof is omitted. Further, the finisher 500 appearing in FIG. 12 is provided with a punch motor in place of the scoring motor M8 appearing in FIG. 4, and does not include the scoring sensor 576.

In the finisher 500 illustrated in FIG. 12, a punch blade 751 and a punch blade receiving member 752 are arranged downstream of the conveying roller pair 532. The punch blade 751 is driven by a punch motor (not shown) under the control of the CPU 952, for performing the punching processing.

Figure 13A:
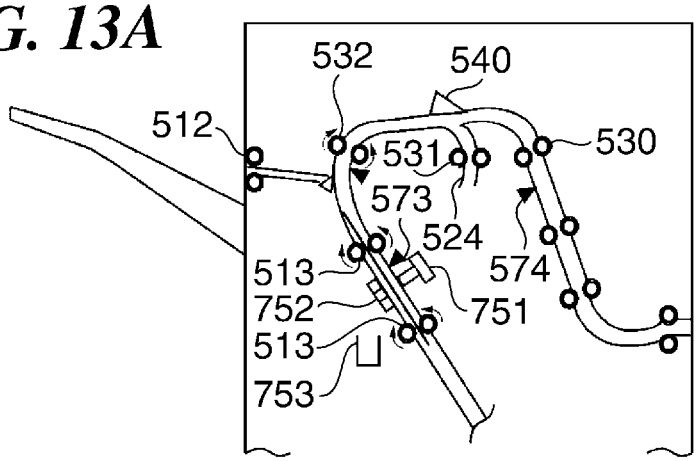
Figure 13B:
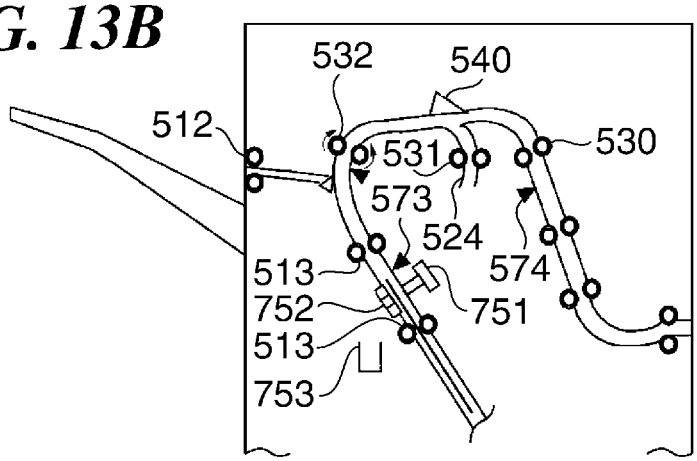
Figure 13C:
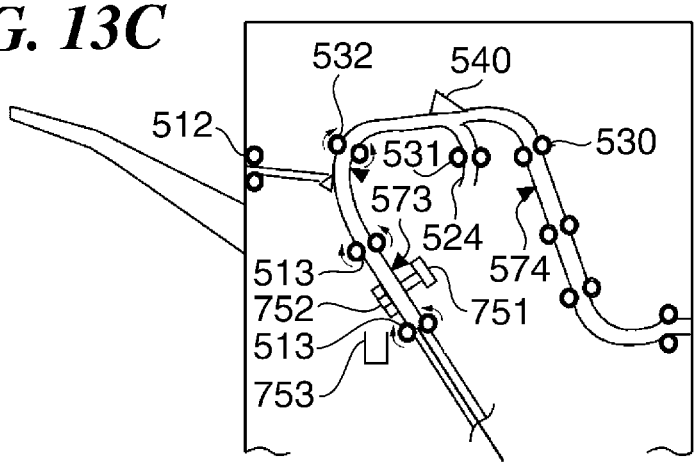

FIGS. 13A to 13C are diagrams useful in explaining the punching processing by the finisher 500 shown in FIG. 12, in which FIG. 13A shows a state where the leading edge of a sheet has been detected by a path sensor, FIG. 13B shows a state where the sheet is at rest at a punching position, and FIG. 13C shows a state where the punched sheet is conveyed again.

When the leading edge of the sheet is detected by the path sensor 573 (see FIG. 13A), the CPU 952 conveys the sheet for a predetermined time period, i.e. over a predetermined distance, and then stops the conveying roller pairs 513 (see FIG. 13B). This causes the sheet to stop at the position of the punch blade receiving member 752.

Then, the CPU 952 drives the punch motor to cause the punch blade 751 to move downward toward the punch blade receiving member 752. This causes the sheet to be held between the punch blade 751 and the punch blade receiving member 752, for being punched. Punch chips caused by the punching are received in a punch chip box 753.

Subsequently, the CPU 952 drives the punch motor for reverse rotation to cause the punch blade 751 to move upward. Then, when the punching of the sheet is terminated, the CPU 952 drives the conveying roller pair 513 to convey the punched sheet to the processing tray 550 or the bookbinding path 523 (see FIG. 13C).

FIG. 14 is a diagram showing an example of an upper-limit sheet count table used by the finisher 500 appearing in FIG. 12.

In the upper-limit sheet count table illustrated in FIG. 14, when the sheet basis weight is smaller than 106 (g/mm$^2$), the upper-limit sheet count is set to 2, whereas when the sheet basis weight is not smaller than 106 (g/mm$^2$), the upper-limit sheet count is set to 1.

The finisher 500 using the upper-limit sheet count table illustrated in FIG. 14 also performs the buffer sheet-setting processing, as described with reference to FIG. 9. The finisher 500 performs buffer processing according to a sheet type (the buffer sheet, the buffer discharge sheet, or the non-buffer sheet) set in the buffer sheet-setting processing, and punches sheet bundles each formed by placing sheets one upon another.

As described hereinabove, the finisher 500 is configured such that during punching a preceding sheet (sheet bundle), buffer processing is performed on a following sheet, and hence it is possible to perform punching without suspending image formation. As a consequence, since it is not required to suspend image formation, it is possible to prevent reduction of productivity in the image forming process.

Although in the buffer sheet-setting process shown in FIG. 9, when the upper-limit sheet count N is not equal to 1, a first sheet is set as a buffer sheet, the buffer sheet-setting process may be controlled as described hereinafter:

When the upper-limit sheet count N is not equal to 1, the CPU 952 determines whether or not a sheet count of one copy set in a print job is an odd number or an even number. If the sheet count is an even number, the CPU 952 sets an odd-number-th sheet as the buffer sheet, and sets an even-number-th sheet as the buffer discharge sheet.

On the other hand, if the sheet count of one copy set is an odd number, the CPU 952 sets a first sheet as the non-buffer sheet, and singly scores the first sheet. The CPU 952 sets even-number-th sheets as the buffer sheet, and sets odd-number-th sheets of a third sheet et seq. as the buffer discharge sheet.

As a consequence, even if the sheet count of sheets of one copy set is e.g. five, the image forming apparatus is not required to increase a conveying interval of a fourth sheet and a fifth sheet than usual. However, to print a plurality of copy sets, the image forming apparatus is required to increase a sheet discharge interval (sheet feeding interval) of a last sheet of an odd-numbered set and a first sheet of a following even-numbered set by a time period taken to perform the scoring processing.

Further, in the buffer sheet-setting process shown in FIG. 9, when the upper-limit sheet count N is equal to 3, if the sheet count of one copy set is equal to 4, first to third sheets are placed one upon another for scoring processing. This requires the image forming apparatus to increase a sheet discharge interval of the third sheet and a fourth sheet by a time period taken to perform the scoring processing. Further, if the sheet count of one copy set is equal to 7, the image forming apparatus is required to increase a sheet discharge interval of a sixth sheet and a seventh sheet by a time period taken to perform the scoring processing.

To meet the above requirements, when the upper-limit sheet count N is equal to 3, the CPU 952 determines whether a sheet count of one copy set in a print job is an odd number or an even number. If the sheet count is an even number, the CPU 952 sets each odd-number-th sheet as the buffer sheet, and sets each even-number-th sheet as the buffer discharge sheet. On the other hand, if the sheet count of one copy set is an odd number, the CPU 952 sets each odd-number-th sheet as the buffer sheet, and sets each even-number-th sheet as the buffer discharge sheet, up to a last sheet but three. Then, the CPU 952 sets each of a last sheet but two and a last sheet but one as the buffer sheet, and sets a last sheet as the buffer discharge sheet. That is, the buffer processing is performed such that sheet bundles each formed of two sheets and a sheet bundle of three sheets are formed. Note that the last sheet is not necessarily required to be included in the sheet bundle of three sheets, but the buffer processing may be performed such that a first or other sheet is included in the sheet bundle of three sheets.

This prevents only one sheet from being conveyed to the scoring section, and makes it possible to necessarily score sheets on a sheet bundle basis, so that the image forming apparatus is not required to increase a sheet discharge interval than usual.

While the present invention has been described with reference to an exemplary embodiment, it is to be understood that the invention is not limited to the disclosed exemplary embodiment. The scope of the following claims is to be accorded the broadest interpretation so as to encompass all modifications, equivalent structures and functions.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

This application claims priority from Japanese Patent Application No. 2012-014196 filed Jan. 26, 2012, and Japanese Patent Application No. 2013-003485 filed Jan. 11, 2013, which are hereby incorporated by reference herein in their entirety.

What is claimed is:

1. A sheet post-processing apparatus that performs processing on a sheet having an image formed thereon, the sheet post-processing apparatus comprising:

a post-processing unit configured to perform processing on a sheet and a sheet bundle, an upper limit value of the number of sheets that said post-processing unit is capable of processing at a time being equal to N, which is an integer, the upper limit value N being set according to a type of sheets;

a buffer unit configured to perform buffer processing for retaining a conveyed sheet and conveying the retained sheet and at least one following sheet in a state placed one upon another as a sheet bundle; and a control unit configured to control said buffer unit and said post-processing unit so such that when said post-processing unit is performing the processing on the sheet or the sheet bundle, said buffer unit performs the buffer processing on a plurality of following sheets not larger in number than the upper limit value N, so that the processing is performed on each sheet bundle formed by the buffer processing, wherein when the upper limit value N is equal to one, said control unit causes the processing to be performed on each sheet without the buffer processing.

2. The sheet post-processing apparatus according to claim 1, wherein said control unit outputs an instruction for increasing a conveying interval of sheets to a device that conveys sheets to the sheet post-processing apparatus.

3. The sheet post-processing apparatus according to claim 1, wherein the upper limit value N is smaller as a sheet basis weight is larger.

4. The sheet post-processing apparatus according to claim 1, wherein the processing includes at least one of a scoring processing for forming a fold line in the sheet and the sheet bundle and a punching processing for punching holes in the sheet and the sheet bundle.

5. A sheet post-processing apparatus that performs processing on a sheet having an image formed thereon, the sheet post-processing apparatus comprising:

a post-processing unit configured to perform processing on a sheet and a sheet bundle, an upper limit value of the number of sheets that said post-processing unit is capable of processing at a time being equal to N, which is an integer;

a buffer unit configured to perform buffer processing for retaining a conveyed sheet and conveying the retained sheet and at least one following sheet in a state placed one upon another as a sheet bundle; and a control unit configured to control said buffer unit and said post-processing unit so that when said post-processing unit is performing the processing on the sheet or the sheet bundle, said buffer unit performs the buffer processing on a plurality of following sheets not larger in number than the upper limit value N, so that the processing is performed on each sheet bundle formed by the buffer processing, wherein when the upper limit value N is not equal to one, said control unit controls said buffer unit such that a single sheet is not conveyed to said post-processing unit.

6. The sheet post-processing apparatus according to claim 5, wherein in a case where the upper limit value N is not equal to one, when the number of sheets of one set of sheets to be subjected to the processing is an even number, said control unit causes said buffer unit to form first and following sheets into sheet bundles each formed of two sheets, whereas when the number of sheets of one set of sheets to be subjected to the processing is an odd number, said control unit causes said buffer unit to form second and following sheets into sheet bundles each formed of two sheets, without causing said buffer unit to perform the buffer processing on the first sheet.

7. The sheet post-processing apparatus according to claim 6, wherein in a case where the number of sheets of one set of sheets to be subjected to the processing is an odd number, said control unit outputs an instruction for increasing a conveying interval of a last sheet of a first set and a first sheet of a second set to a device that conveys sheets to the sheet post-processing apparatus.

8. The sheet post-processing apparatus according to claim 5, wherein in a case where the upper limit value N is larger than two, when the number of sheets of one set of sheets to be subjected to the processing is an even number, said control unit causes said buffer unit to form the sheets into a sheet bundle each formed of two sheets, whereas when the number of sheets of one set of sheets to be subjected to the processing is an odd number, said control unit controls said buffer unit to form the sheets into sheet bundles each formed of two sheets and a sheet bundle of three sheets.

9. The sheet post-processing apparatus according to claim 5, wherein the processing includes at least one of a scoring processing for forming a fold line in the sheet and the sheet bundle or a punching processing for punching holes in the sheet and the sheet bundle.

10. A sheet post-processing apparatus according to claim 1, that performs processing on a sheet having an image formed thereon, the sheet post-processing apparatus comprising:

a post-processing unit configured to perform processing on a sheet and a sheet bundle, an upper limit value of the number of sheets that said post-processing unit is capable of processing at a time being equal to N, which is an integer;

a buffer unit configured to perform buffer processing for retaining a conveyed sheet and conveying the retained sheet and at least one following sheet in a state placed one upon another as a sheet bundle;

a control unit configured to control said buffer unit and said post-processing unit so that when said post-processing unit is performing the processing on the sheet or the sheet bundle, said buffer unit performs the buffer processing on a plurality of following sheets not larger in number than the upper limit value N, so that the processing is performed on each sheet bundle formed by the buffer processing; and a decision unit configured to decide, according to a buffer sheet count indicative of the number of sheets to be retained by said buffer unit, whether the conveyed sheet is a predetermined first sheet to be conveyed to said post-processing unit without being subjected to the buffer processing, a predetermined second sheet to be retained by said buffer unit, or a predetermined third sheet to be placed on the second sheet without being retained by said buffer unit.

11. The sheet post-processing apparatus according to claim 10, wherein when the upper limit value N is equal to one, said decision unit decides that the conveyed sheet is the predetermined first sheet.

12. The sheet post-processing apparatus according to claim 10, wherein in a case where the conveyed sheet is not a last sheet to be subjected to the processing, when the upper limit value N is equal to or larger than two and at the same time the buffer sheet count is smaller than a sheet count smaller by one than the upper limit value N, said decision unit decides that the conveyed sheet is the predetermined second sheet.

13. The sheet post-processing apparatus according to claim 12, wherein when the upper limit value N is equal to or larger than two and at the same time the buffer sheet count is smaller by one than the upper limit value N, said decision unit decides that the conveyed sheet is the predetermined third sheet.

14. The sheet post-processing apparatus according to claim 10, wherein in a case where the conveyed sheet is a last sheet to be subjected to the processing, when the upper limit value N is equal to or larger than two and at the same time the buffer sheet count is equal to zero, said decision unit decides that the conveyed sheet is the predetermined first sheet not being subjected to the buffer processing.

15. The sheet post-processing apparatus according to claim 10, wherein in a case where the conveyed sheet is a last sheet to be subjected to the processing, when the upper limit value N is equal to or larger than two and at the same time the buffer sheet count is not equal to zero, said decision unit decides that the conveyed sheet is the predetermined third sheet.

16. The sheet post-processing apparatus according to claim 10, wherein the processing includes at least one of a scoring processing for forming a fold line in the sheet and the sheet bundle or a punching processing for punching holes in the sheet and the sheet bundle.

17. An image forming apparatus comprising:

a printing unit configured to perform image formation on a sheet;

a post-processing unit configured to perform processing on a sheet and a sheet bundle on which said printing unit has performed image formation, an upper limit value of a sheet count of sheets that said post-processing unit is capable of processing at a time being equal to N, which is an integer, the upper limit value N being set according to a type of sheets;

a buffer unit configured to perform buffer processing for retaining a conveyed sheet and conveying the retained sheet and at least one following sheet in a state placed one upon another as a sheet bundle; and a control unit configured to control said buffer unit and said post-processing unit so that when said post-processing unit is performing the processing on the sheet or the sheet bundle, said buffer unit performs the buffer processing on a plurality of following sheets not larger in number than the upper limit value N, so that the processing is performed on each sheet bundle formed by the buffer processing, wherein when the upper limit value N is equal to one, said control unit causes the processing to be performed on each sheet without the buffer processing.

18. An image forming apparatus comprising:

a printing unit configured to perform image formation on a sheet;

a post-processing unit configured to perform processing on a sheet and a sheet bundle on which said printing unit has performed image formation, an upper limit value of a sheet count of sheets that said post-processing unit is capable of processing at a time being equal to N, which is an integer;

a buffer unit configured to perform buffer processing for retaining a conveyed sheet and conveying the retained sheet and at least one following sheet in a state placed one upon another as a sheet bundle; and a control unit configured to control said buffer unit and said post-processing unit so that when said post-processing unit is performing the processing on the sheet or the sheet bundle, said buffer unit performs the buffer processing on a plurality of following sheets not larger in number than the upper limit value N, so that the processing is performed on each sheet bundle formed by the buffer processing, wherein when the upper limit value N is not equal to one said control unit controls said buffer unit such that a single sheet is not conveyed to said post-processing unit.

19. An image forming apparatus comprising:

a printing unit configured to perform image formation on a sheet;

a post-processing unit configured to perform processing on a sheet and a sheet bundle on which said printing unit has performed image formation, an upper limit value of a sheet count of sheets that said post-processing unit is capable of processing at a time being equal to N, which is an integer;

a buffer unit configured to perform buffer processing for retaining a conveyed sheet and conveying the retained sheet and at least one following sheet in a state placed one upon another as a sheet bundle;

a control unit configured to control said buffer unit and said post-processing unit so that when said post-processing unit is performing the processing on the sheet or the sheet bundle, said buffer unit performs the buffer processing on a plurality of following sheets not larger in number than the upper limit value N, so that the processing is performed on each sheet bundle formed by the buffer processing; and a decision unit configured to decide, according to a buffer sheet count indicative of the number of sheets to be retained by said buffer unit, whether the conveyed sheet is a predetermined first sheet to be conveyed to said post-processing unit without being subjected to the buffer processing, a predetermined second sheet to be retained by said buffer unit, or a predetermined third sheet to be placed on the second sheet without being retained by said buffer unit.

* * * * *